United States Patent [19]

Olesen

[11] Patent Number: 5,004,142

[45] Date of Patent: Apr. 2, 1991

[54] GUIDE ANVIL INCLUDING MOVABLE CLINCHING WINGS FOR STAPLER

[75] Inventor: Paul Olesen, Bellmore, N.Y.

[73] Assignee: Swingline Inc., Long Island City, N.Y.

[21] Appl. No.: 300,510

[22] Filed: Jan. 23, 1989

[51] Int. Cl.[5] ..... B25C 7/00

[52] U.S. Cl. ..... 227/155

[58] Field of Search ..... 227/84, 85, 154, 155, 227/156, 29, DIG. 1

[56] References Cited

U.S. PATENT DOCUMENTS

| | | | |
|---|---|---|---|
| 2,267,185 | 12/1941 | Bauwens | 227/155 |
| 2,268,371 | 12/1941 | Bauwens | 227/155 |
| 4,194,666 | 3/1980 | Spehrley, Jr. et al. | 227/155 |
| 4,449,661 | 5/1984 | Spehrley, Jr. | 227/155 |
| 4,546,910 | 10/1985 | Logtens | 227/155 |
| 4,593,847 | 6/1986 | Hagemann | 227/155 |

FOREIGN PATENT DOCUMENTS

| | | | |
|---|---|---|---|
| 541833 | 12/1941 | United Kingdom | 227/155 |

*Primary Examiner*—Douglas D. Watts
*Assistant Examiner*—Thomas Hamill, Jr.
*Attorney, Agent, or Firm*—Pennie & Edmonds

[57] ABSTRACT

An anvil unit for guiding and clinching staples as driven downwardly in a vertical plane in which each staple leg is guided into a guide means in the unit, each guide means lies at an angle to such vertical plane. Communicating with forming a part of each guide means is a slot, at an angle to the vertical plane, with a swingable wing thereon for clinching the staple legs after each has penetrated the workpiece.

2 Claims, 2 Drawing Sheets

GUIDE ANVIL INCLUDING MOVABLE CLINCHING WINGS FOR STAPLER

BACKGROUND OF THE INVENTION

Movable anvils for assisting in the clinching of staples are old (U.S. Pat. Nos. 2,267,185 and 4,546,910); however, their construction and operation have not been satisfactory for many applications.

SUMMARY OF THE INVENTION

Broadly, the present invention comprises a stapler for driving staples in a vertical plane including a stationary anvil body positioned at an angle to the vertical plane for guiding each of the staple legs into two parallel slots in which are operated two pivotal anvil wings for pivotal movement to engage, bend, and clinch the legs in such a manner that the legs bend in adjacent vertical planes and may, therefore, bypass one another as clinched.

DESCRIPTION OF THE PREFERRED EMBODIMENT

Figure 1:
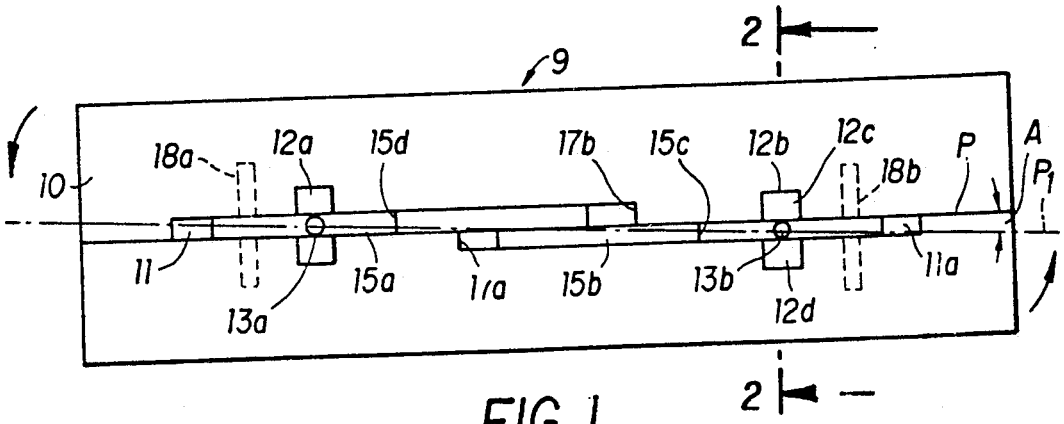
FIG. 1 is a top plan view of the anvil unit of the present invention positioned on an angle.
Figure 2:
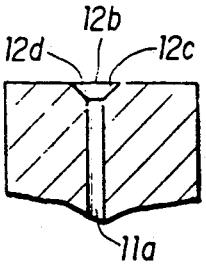
FIG. 2 is a sectional view along the line 2—2 of FIG. 1.
Figure 3:
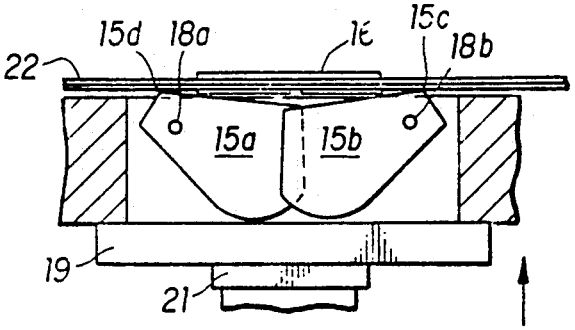
FIG. 3 is a partial elevational view of the anvil unit after the anvil wings have clinched the staple.
Figure 2A:
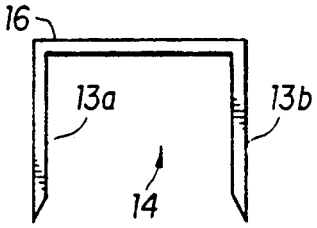
FIG. 2*a* is a side elevational view of a staple prior to driving and clinching.
Figure 4:
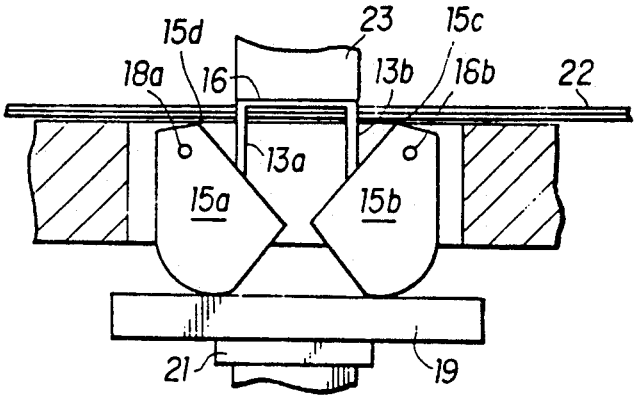
FIG. 4 is a partial elevational view of the anvil unit before clinching.
Figure 5:
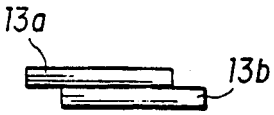
FIG. 5 is a partial bottom view of a clinched staple showing the staple legs in parallel side-by-side planes.

In FIGS. 1–5, anvil unit 9 includes body 10 which has two vertical slots 11 and 11*a* which lie in parallel side-by-side vertical planes. Slots 11 and 11*a* communicate with one another along vertical plane P which is angled a few degrees, angle A, to the vertical staple driving plane $P_1$. Perpendicular to slot 11*a* is staple leg guide ramp 12*b* having opposed sloping surfaces 12*c*, 12*d*. Thus, as staple leg 13*b* of staple 14 is driven downwardly by driver blade 23 (FIG. 4), leg 13*b*, if not perfectly aligned with slot 11*a*, engages guide ramp 12*b* guiding leg 13*b* into vertical slot 11*a*. Similarly, the other staple leg 13*a* is guided by ramp 12*a*, as necessary, into slot 11. Since anvil unit 9 is angled, staple crown 15 is not subjected to twisting or other distortion while its legs 13*a*, 13*b* are bent out of plane $P_1$. Each leg 13*a*, 13*b*, upon penetrating workpiece 22 and being guided as described above, engages its pivotal clinching wing 15*a*, 15*b*, which wings 15*a*, 15*b* (as housed in slots 11, 11*a*) lie in different but parallel planes, causing legs 13*a*, 13*b* to bend as driving continues or as wings 15*a*, 15*b* are rotated or both.

Preferably, anvil unit 9 and the size of the staplers being driven are proportioned so that leg 13*b* comes into contact with wing 15*b* between wing edge 15*c* and slot end 17*b* of slot 11 and bending starts in this area to avoid leg 13*b* moving into slot 11 and interfering with the bending of leg 13*a*. If bending starts to the left of slot end 17*b*, leg 13*b* may ride off wing 15*b* (before it starts to bend) and enter slot 11. Similarly, points 15*d* and 17*a* define limits of a target engagement area for leg 13*a* for the same reasons.

Clinching wings 15*a*, 15*b*, pivotal about pivot pins 18*a*, 18*b*, are caused to move upwardly by plate 19 powered by solenoid 21. Since legs 13*a*, 13*b* are oriented by ramps 12*a*, 12*b* to be aligned with wings 15*a*, 15*b* lying in side-by-side planes, legs 13*a*, 13*b* as clinched lie in side-by-side or adjacent planes. Where the workpiece 22 is relatively thin, legs 13*a*, 13*b* pass one another (FIG. 5); however, if the workpiece 22 is thick enough legs 13*a*, 13*b* though still lying in side-by-side planes, would not pass each other.

Figure 6:
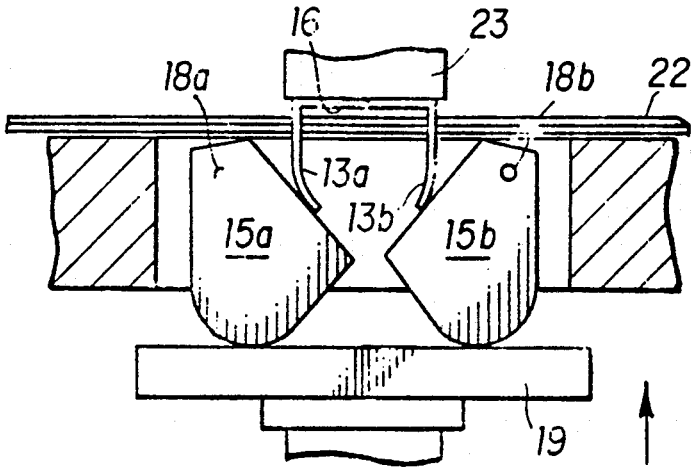
FIG. 6 is a partial elevational view of the anvil unit adjusted to commence clinching prior to the staple crown reaching the work surface.

Turning to FIG. 6, the movement of wings 15*a*, 15*b* has been controlled to start clinching of staple legs 13*a*, 13*b* prior to staple crown 16 reaching the surface of workpiece 22.

I claim:

1. An anvil unit having a stationary portion and movable portions for guiding and clinching a staple having a crown and two legs including drive means for driving the staple in a vertical plane comprising a. a stationary anvil portion having side-by-side vertical parallel slots each angled to the vertical plane which slots each in turn include a guide means for guiding each staple leg.

b. a slot end of each slot positioned between the guide means of each slot and such slot ends being spaced apart a distance with each slot connected together over such distance;

c. sloping surfaces on each guide means for guiding the staple leg into a slot;

d. a pivotal clinching anvil wing portion positioned in each of the slots to pivot for engaging and thereafter bending the leg to a clinch position, each of said anvil wing portions adjacent one another during such pivotal movement; and e. power means for moving the clinching wing portions to clinch the staple legs.

2. An anvil unit having a stationary portion and movable portions for guiding and clinching a staple having a crown and two legs including drive means for driving the staple in a vertical plane comprising a. a stationary anvil portion having side-by-side vertical parallel slots each angled to the vertical plane which slots each in turn include a guide means for guiding each staple leg;

b. a slot end of each slot positioned between the guide means of each slot and such slot ends being spaced apart a distance with each slot connected together over such distance;

c. sloping surfaces on each guide means for guiding the staple leg into a slot;

d. a pivotal clinching anvil wing portion positioned in each of the slots to pivot for engaging and thereafter bending the leg to a clinch position, each of said anvil wing portions adjacent one another during such pivotal movement; and e. power means for moving the clinching wing portions to clinch the staple legs, whereby the wing portions and staple size are such that the legs engage the wing portions and become bent before the legs can enter a connected vertical slot.

* * * * *